US009556659B2

(12) United States Patent
Fan

(10) Patent No.: US 9,556,659 B2
(45) Date of Patent: Jan. 31, 2017

(54) DOOR CLOSER CAPABLE OF ADJUSTING ITS CLOSING SPEED

(71) Applicant: CMECH (GUANGZHOU) INDUSTRIAL LTD., Guangzhou (CN)

(72) Inventor: Shuiwang Fan, Guangzhou (CN)

(73) Assignee: Cmech (Guangzhou Industrial Ltd.), Guangzhou (CN)

( * ) Notice: Subject to any disclaimer, the term of this patent is extended or adjusted under 35 U.S.C. 154(b) by 0 days.

(21) Appl. No.: 14/795,004

(22) Filed: Jul. 9, 2015

(65) Prior Publication Data

US 2016/0362924 A1 Dec. 15, 2016

(30) Foreign Application Priority Data

Jun. 11, 2015 (CN) ..... 2015 1 0318849

(51) Int. Cl.

| | |
|---|---|
| ***E05F 1/10*** | (2006.01) |
| ***E05F 3/00*** | (2006.01) |
| ***E05F 3/02*** | (2006.01) |
| ***E05F 5/08*** | (2006.01) |

(52) U.S. Cl.

CPC .. *E05F 3/02* (2013.01); *E05F 5/08* (2013.01)

(58) Field of Classification Search

CPC ..... Y10T 16/56; Y10T 16/577; Y10T 16/585; Y10T 16/27; Y10T 16/2804; Y10T 16/281; Y10T 16/285; Y10T 16/286; Y10T 16/293; Y10T 16/299; Y10T 16/61; Y10T 16/62; E05F 3/00; E05F 3/02; E05F 3/04; E05F 3/102; E05F 3/104; E05F 3/10; E05F 3/227; E05F 5/06; E05F 5/08; E05F 5/10; E05F 2003/228; E05C 17/04; E05C 17/28; E05C 17/30

See application file for complete search history.

(56) References Cited

U.S. PATENT DOCUMENTS

| | | | | | |
|---|---|---|---|---|---|
| 1,966,956 | A | * | 7/1934 | Dunn | E05F 5/027 16/49 |
| 2,108,891 | A | * | 2/1938 | Johnson | E05F 3/16 16/66 |
| 2,958,089 | A | * | 11/1960 | Roehm | E05C 17/24 16/49 |

(Continued)

FOREIGN PATENT DOCUMENTS

| | | | | | |
|---|---|---|---|---|---|
| CN | 201106346 | Y | | 8/2008 | |
| DE | 102011087695 | | * | 6/2013 | E05F 5/08 |
| JP | 2008196256 | A | | 8/2008 | |

*Primary Examiner* — Chuck Mah

(74) *Attorney, Agent, or Firm* — McKee Voorhees and Sease PLC

(57) ABSTRACT

A door closer capable of adjusting its closing speed, including a gas adjusting apparatus arranged on the door frame, a driving apparatus arranged on the door, and a lever is provided. One end of the lever is movably connected to the gas adjusting apparatus, and the other end is connected to the driving apparatus. The gas adjusting apparatus includes a sliding rail arranged on the door frame, and a sliding member cooperated with the sliding rail; a hermetic chamber is formed by the sliding member and the sliding rail, an adjusting member, for adjusting the exhaust of the hermetic chamber, is configured on a side wall of the hermetic chamber. The lever is movably configured on the sliding member.

17 Claims, 6 Drawing Sheets

(56) References Cited

U.S. PATENT DOCUMENTS 3,630,560 A * 12/1971 Atkins ..... E05C 17/28 16/49
4,506,407 A * 3/1985 Downey ..... E05C 17/28 16/320
4,837,890 A * 6/1989 Tully ..... E05C 17/28 16/71
4,847,946 A * 7/1989 Nam ..... E05F 3/102 16/53
4,858,272 A * 8/1989 Ogawa ..... E05F 3/221 16/71
5,666,692 A * 9/1997 Toledo ..... E05F 3/104 16/51
5,829,097 A * 11/1998 Toledo ..... E05C 17/26 16/53
5,829,508 A * 11/1998 DeBower ..... E05F 3/221 16/49
5,842,255 A * 12/1998 Luca ..... E05C 17/30 16/49
5,956,806 A * 9/1999 Tutikawa ..... E05F 3/02 16/49
6,138,412 A * 10/2000 Rieckmann ..... E05F 15/53 49/340
8,875,344 B2 11/2014 Salutzki et al.
2002/0066157 A1* 6/2002 Chen ..... E05F 3/104 16/58
2002/0133904 A1* 9/2002 Donovan ..... E05F 3/16 16/49
2004/0035057 A1* 2/2004 Backman ..... E05F 3/102 49/340
2005/0125947 A1* 6/2005 Kral ..... E05F 1/1066 16/67
2009/0320236 A1* 12/2009 Yamamuro ..... E05F 3/102 16/64
2013/0081227 A1* 4/2013 Hensh ..... E05F 3/104 16/53
2013/0086771 A1* 4/2013 Blockley ..... E05F 3/12 16/56
2015/0322705 A1* 11/2015 Lee ..... E05F 3/102 16/53

* cited by examiner

DOOR CLOSER CAPABLE OF ADJUSTING ITS CLOSING SPEED

CROSS REFERENCE TO RELATED APPLICATION

This application claims priority to Chinese Application No. CN 201510318849.8 having a filing date of Jun. 11, 2015, the entire contents of which are hereby incorporated by reference.

FIELD OF TECHNOLOGY

The following relates to the field of door closers, in particular a door closer capable of adjusting its closing speed.

BACKGROUND

The closing speed of a door closer is usually controlled by controlling the flow velocity of oil therein. However, the viscosity of oil varies upon changing temperature, to affect the closing speed of door closers greatly in the regions having big diurnal temperature amplitude, e.g. North America and the North China. It can be known from the experiments, the closing time of a hydraulic door closer is about 8 seconds at 25° C., but when the air temperature dropped down to minus 20° C., the closing time is increased to about 2 minutes, which is 15 times the former. A much longer closing time can cause many problems, for example, the cold air in winter can enter the house easily, or a security flaw will appear. Moreover, it is difficult for users to adjust the door closer, the above flaws should increase the maintenance service cost and may incur a risk of oil spilling.

SUMMARY

An aspect relates to a door closer capable of adjusting its closing speed, which is less influenced by temperature and has a constant closing speed.

Disclosed is the following solution.

A door closer capable of adjusting its closing speed according to embodiments of the invention, comprising a gas adjusting apparatus arranged on the door frame, a driving apparatus arranged on the door, and a lever; one end of the lever is movably connected to the gas adjusting apparatus, and the other end is connected to the driving apparatus;

the gas adjusting apparatus comprises a sliding rail arranged on the door frame, and a sliding member cooperated with the sliding rail; a hermetic chamber is formed by the sliding member and the sliding rail, an adjusting member, for adjusting the exhaust of the hermetic chamber, is configured on a side wall of the hermetic chamber, and the lever is movably configured on the sliding member;

the driving apparatus comprises a receiving chamber on the door, an elastic component in the receiving chamber, for storing resilience, a pulley movably configured on the door, and driving components for transferring the resilience to the pulley; the lever is fixedly connected to the pulley.

Furthermore, in order to form a better hermetic chamber, the sliding member comprises a sliding block, a piston and a joint rod for connecting the sliding block and the piston; a hermetic chamber is formed by the piston and the sliding rail, the lever is hinged to the sliding block.

Furthermore, the sliding member is provided with an air-in configuration which comprises a groove on the periphery of the sliding member, a seal ring movably configured in the groove, and an air intake through the sliding member, making both sides space of the sliding member be connected;

a first side wall and a second side wall are formed at the groove, wherein the first side wall is adjacent to the hermetic chamber while the second side wall is opposite the first side wall; a first air intake is configured on the first side wall;

there is a gap between the second side wall and an inner side wall of the sliding rail, the second side wall is inclined from bottom of the groove, such that air enters the hermetic chamber through the first air intake and the gap when the piston slides towards left side, the air in the hermetic chamber is then compressed and the seal ring seals the gap, and thereby the air could be exhausted only by a regulating valve. Therefore, the counteraction to the piston could be adjusted by adjusting the exhaust of the regulating valve, and thereby the sliding speed of the sliding block could be adjusted.

Furthermore, the elastic component is a spring.

Furthermore, the pulley is a cam, and the driving components comprises a driving piston configured at one end of the spring, and a cam roller on the driving piston; the cam roller is tangent to the profile of the cam; the intersection of the cam roller and the cam deviates from a line from the center of the cam roller to the shaft of the cam; the other end of the spring is connected with a side wall of the receiving chamber, the profile of the cam is designed to balance the varied resilience of the spring, such that the door is closed uniformly. Further, in order to close the door eventually, it can ensure there is a sufficient thrust to the door being locked at the last moment.

Furthermore, the pulley is a gear, the driving component is a rack engaged with the gear, the rack is connected to one end of the spring, the other end of the spring is connected with a side wall of the receiving chamber.

Furthermore, a housing is configured on the door, and provided with a receiving chamber for receiving the driving apparatus.

Furthermore, the adjusting member is a regulating valve, for convenience.

Furthermore, the sliding rail is a cylinder, the regulating valve is configured on one end of the hermetic chamber, a vent is configured on the other end of the hermetic chamber, and a slot for the lever is arranged on the cylinder.

Furthermore, for aesthetics purpose, the gas adjusting apparatus is embedded into the beam of the door frame, and the housing is embedded into the top of the door.

Compared with the prior art, the beneficial effects are (1) The hermetic chamber is formed by the piston and the cylinder, such that the sliding speed of the sliding block, and further the closing speed of the door, could be controlled by adjusting the regulating valve. As the air flow is insensitive to air temperature, the closing speed of the door can be constant whatever the air temperature varies. Thus the regulating valve can be adjusted when the door closer was installed, such that it could be used reliably all along.

(2) The driving structure is formed by the cam and the spring, when the door starts closing, the spring possesses a great resilience, but when the door almost close completely, the spring possesses a small resilience. The closing force can be adjusted by the profile of the cam as the resilience of the spring is varied all the way, thus the door is closed uniformly. In addition, it can ensure there is a sufficient thrust to the door being locked eventually, and eliminates the risk of hitting people getting through the door.

(3) The following uses air for controlling, this reduces the cost and the maintenance service fee, and eliminates the contamination of oil spilling.

BRIEF DESCRIPTION

Preferred embodiments of the present invention will be further described in detail hereinafter with reference to the accompanying drawings.

REFERENCE LIST

Figure 1:
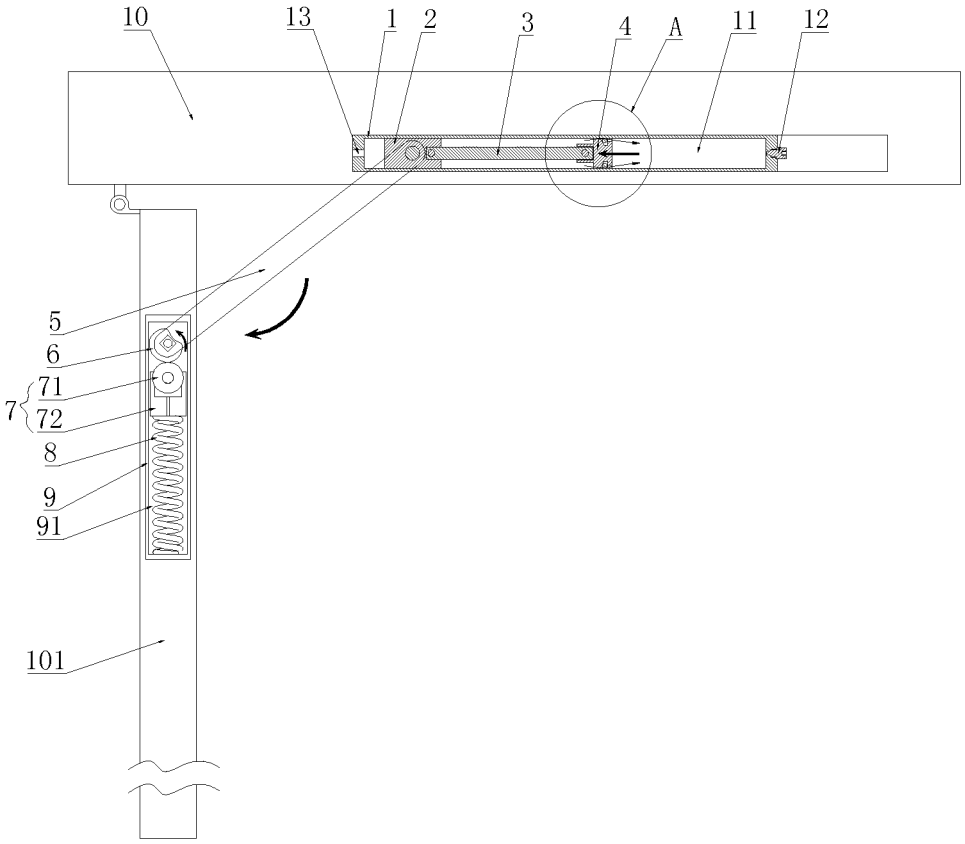
FIG. 1 is a structural view of the door closer capable of adjusting its closing speed when the door was open at the angle of 90 degrees.
Figure 2:
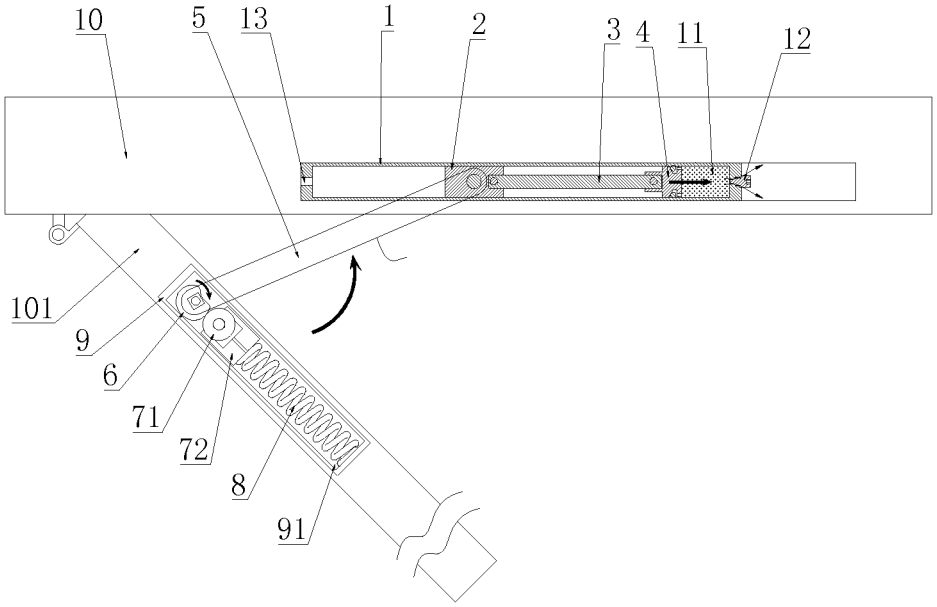
FIG. 2 is a structural view of the door closer capable of adjusting its closing speed when the door was open at the angle of 45 degrees.
Figure 3:
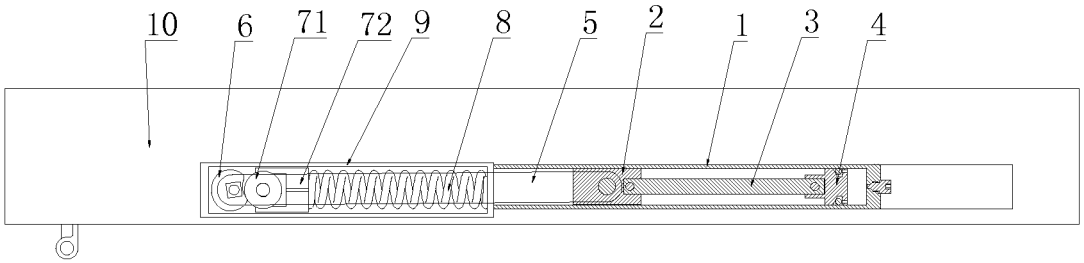
FIG. 3 is a structural view of the door closer capable of adjusting its closing speed when the door closed completely.
Figure 4:
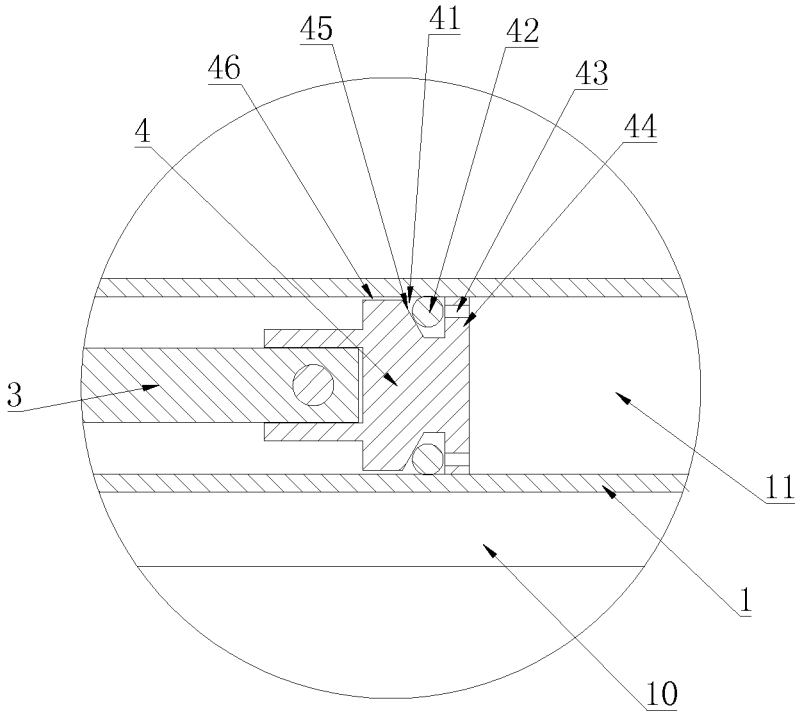
FIG. 4 is a partial enlarged view of section A in FIG. 1.
Figure 5:
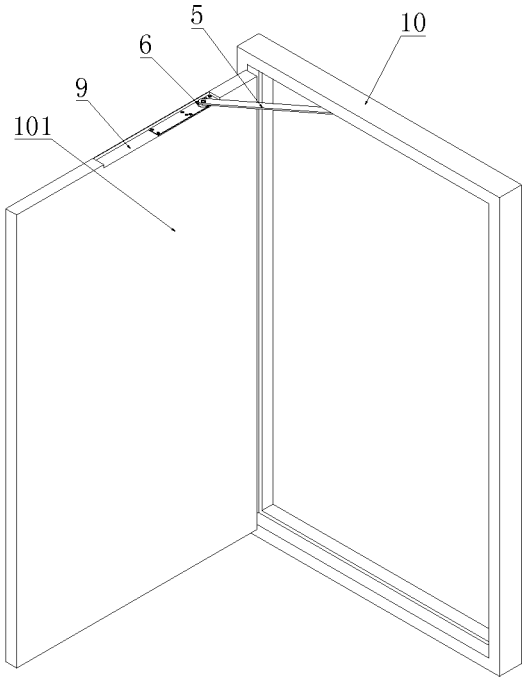
FIG. 5 is a schematic view of the door closer capable of adjusting its closing speed during the closer works.

1—cylinder
11—hermetic chamber
12—regulating valve
13—vent
2—sliding block
3—joint rod
4—piston
41—groove
42—seal ring
43—first air intake
44—first side wall
45—second side wall
46—gap
5—lever
6—cam
7—driving component
71—cam roller
72—driving piston
73—gear
74—rack
8—spring
9—housing
91—receiving chamber
10—door frame
101—door

DETAILED DESCRIPTION

Preferred embodiments of the invention will be further described in detail hereinafter with reference to the accompanying drawing. However, it should be understood that the preferred embodiments herein are only described for explaining the present invention, the invention is not limited to the embodiments described herein.

Embodiment 1

As shown in FIGS. 1 to 5, a door closer capable of adjusting its closing speed according to embodiments of the present invention, comprises a cylinder 1 configured on the door frame 10, a gas adjusting apparatus inside the cylinder 1, a housing 9 configured on the door where a receiving chamber 91 is set up inside the housing 9, a driving apparatus configured in the receiving chamber 91, and a lever 5 connecting the gas adjusting apparatus and a driving apparatus.

The gas adjusting apparatus comprises a sliding block 2, a piston 4 and a joint rod 3 for connecting the sliding block 2 and the piston 4, inside the cylinder 1; a hermetic chamber 11 is formed by the piston 4 and the cylinder 1, a regulating valve 12, for adjusting the exhaust velocity of the hermetic chamber 11, is configured on a side wall of the hermetic chamber 11. The other end of the cylinder 1 which is away from the hermetic chamber 11, is provided with a vent 13.

The piston 4 has an air-in configuration comprising a groove 41 on the periphery of the piston 4, and a seal ring movably configured in the groove 41. The groove 41 has a first side wall 44 and a second side wall 45, wherein the first side wall 44 is adjacent to the hermetic chamber 11 while the second side wall 45 is opposite the wall 44. A first air intake 43 is configured on the first side wall 44. There is a gap 46 between the second side wall 45 and the inner side wall of the cylinder 1. The first side wall 44 which contact with the seal ring 42 is a plane perpendicular to the direction of movement of the piston 4, while the second side wall 45 which contact with the seal ring 42 is an inclined plane from bottom of the groove 41.

The driving apparatus comprises a cam 6, a spring 8 and driving components 7, inside the receiving chamber 91. The driving components 7 comprise a driving piston 72 and a cam roller 71 configured on the driving piston 72. One end of the spring 8 is connected with an end of the receiving chamber 91 while the other end is connected to the driving piston 72. The intersection of the cam roller 71 and the cam 6 deviates from a line from the center of the cam roller 71 to the shaft of the cam 6.

One end of the lever 5 is hinged to the sliding block 2, while the other end is fixed to the shaft of the cam 6.

In the embodiment, the cylinder 1 is embedded into the beam of the door frame 10, and the housing 9 is embedded into the top of the door. However, the cylinder 1 and the housing 9 of embodiments of the present invention is not limited to such positions, they may be configured at the bottoms of the door frame and the door instead, upon actual requirement. Besides, it may be unnecessary to embed the cylinder 1 and the housing 9 into the door frame 10 and the door 101. Respectively, they may be configured on the door frame 10 and the door 101.

The cylinder 1 in the embodiment is used as a guide rail for the sliding block 2, however, this is not a limitation to embodiments of the present invention. Alternatively, the cylinder 1 could be divided into two parts, wherein one part would be a hermetic cylinder for installing the piston 4, while the other part would be an open guide rail to cooperate with the sliding block 2.

The sliding members in the embodiment are the sliding block 2 and the piston 4, which are connected together by the joint rod, however, this is not a limitation to embodiments of the present invention. Alternatively the sliding block 2 and the piston 4 could be integrated together inside the cylinder.

The work principle of the door closer of embodiments of the present invention is as follows:

When the door 101 is opened manually, the door 101 drives the sliding block 2 sliding towards left side in FIG. 1 through the lever 5, then the sliding block 2 brings the piston 4 sliding towards left side as well through the joint rod 3, and air enters the hermetic chamber 11 through the gap 46 and the first air intake 43. Meanwhile the lever 5 drives the cam 6 rotating about its shaft, the cam 6 drives the cam roller 71 compressing the spring 8. When the door 101 is released, the spring 8 stretches and drives the cam roller 71, subsequently the cam roller 71 drives the cam 6 rotating about its shaft. In the meantime, the sliding block 2 is driven by the lever 5 and slides towards right side in FIG. 1, while the piston 4 is driven by the joint rod 3 and slides towards right side to compress the air in the hermetic chamber 11, simultaneously the air in the hermetic chamber 11 counteracts the movement of the piston 4, and the seal ring 42 is forced to contact with the second side wall 45 and seals the gap 46, such that the air in the hermetic chamber 11 can only be exhausted through the regulating valve 12. Thereby the counteraction to the piston 4 can be adjusted by adjusting the exhaust of the regulating valve 12, and then the sliding speed of the sliding block 2 and further the closing speed of the door could be adjusted. When the door starts closing, the spring 8 possesses a great resilience and can provide a great pushing force, but when the door almost closes completely, the spring 8 possesses a small resilience and only provides a little pushing force to the cam 6. Therefore, the profile of the cam 6 may be designed to balance the resilience variation of the spring. When the door starts closing, the intersection of the cam roller and the cam is designed to be adjacent to the straight line from the shaft of the cam 6 to the center of the cam roller 71 as close as possible, and when the door almost closes completely, the intersection is away from the straight line, whereby the closing speed of the door is almost uniform. In addition, it can ensure there is a sufficient thrust to the door being locked eventually.

Embodiment 2

Figure 6:
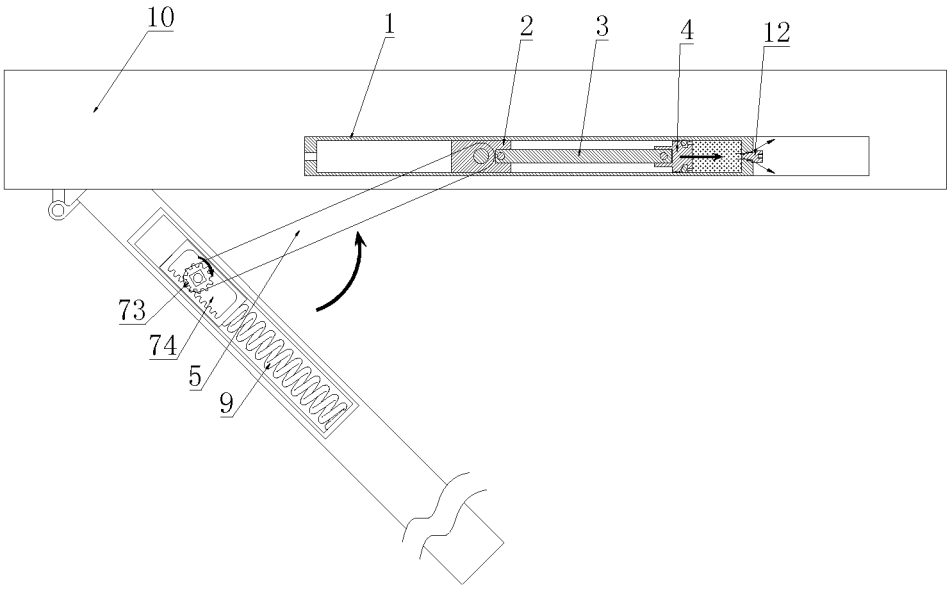
FIG. 6 is a structural view of further embodiment of the door closer capable of adjusting its closing speed.

As shown in FIG. 6, the structure and work principle in this embodiment are identical to those in Embodiment 1, except the driving components. Here a pulley is a gear 73 and the driving component is a rack 74 engaged with the gear 73; the other end of the rack 74 is connected to the spring 8. One end of the lever 5 is hinged to the sliding block 2 while other end is fixed to the shaft of the gear 73.

When the door is open, the lever 5 drives the gear 73 rotating, the rack 74 is forced towards the spring 8, thereby the spring 8 possesses a great resilience. When the door 101 is released, the spring 8 drives the rack 74, and further the gear 73 rotating, such that the lever 5 drives the sliding block 2 sliding towards right side in FIG. 6, whereby the door can close automatically. The counteraction to the piston 4 could be adjusted by adjusting the exhaust of the regulating valve 12, and thereby the closing speed of the door can be adjusted.

In embodiments of the present invention, the hermetic chamber is formed by the piston and the cylinder, such that the sliding speed of the sliding block, and further the closing speed of the door, could be controlled by adjusting the regulating valve. As the air flow is insensitive to air temperature, the closing speed of the door can be constant whatever the air temperature varies. Thus the regulating valve can be adjusted when the door closer was installed, such that it could be used reliably all along. Such door closer reduces the cost and eliminates the contamination of oil spilling.

The other structure of the door closer in the embodiments may refer to known door closers.

Certainly, the embodiments described hereinbefore are merely preferred embodiments of the present invention and not for purposes of any restrictions or limitations on the invention. It will be apparent that any non-substantive, obvious alterations or improvement by the technician of this technical field according to the present invention may be incorporated into ambit of claims of the present invention.

The invention claimed is:

1. A door closer capable of adjusting its closing speed for use with a door and a door frame, comprising:

a gas adjusting apparatus arranged on the door frame, a driving apparatus arranged on the door, and a lever having opposite ends, with one end of the lever connected to the gas adjusting apparatus and the other end connected to the driving apparatus;

whereby the gas adjusting apparatus and the driving apparatus are connected by the lever to control closing of the door;

the gas adjusting apparatus comprising:

a sliding rail adapted to be arranged on the door frame;

a sliding member slidably mounted in the sliding rail, a hermetic chamber formed by the sliding member and the sliding rail, an adjusting member for adjusting an exhaust of the hermetic chamber, and configured on a side wall of the hermetic chamber; and the lever configured on the sliding member;

wherein the driving apparatus comprises;

a receiving chamber adapted for mounting on the door, an elastic component in the receiving chamber for storing resilience, a pulley adapted to be rotatably mounted on the door;

a driving cam operatively connected to the pulley for transferring the resilience to the pulley; and wherein the lever is fixedly connected to the pulley;

whereby opening the door compresses the elastic component and slides the sliding member to increase the volume of the hermetic chamber; and whereby when the open door is released, the elastic member decompresses while the sliding member slides to discharge gas from the hermetic chamber, thereby controlling closing speed of the door.

2. The door closer of claim 1, wherein the sliding member comprises a sliding block, a piston and a joint rod for connecting the sliding block and the piston; a hermetic chamber is formed by the piston and the sliding rail, the lever is hinged to the sliding block.

3. The door closer of claim 1, wherein the sliding member is provided with an air-in configuration which comprises a groove on the periphery of the sliding member, a seal ring movably configured in the groove, an air intake through the sliding member;

a first side wall and a second side wall are formed at the groove, wherein the first side wall is adjacent to the hermetic chamber while the second side wall is opposite the first side wall;

the air intake being configured on the first side wall;

a gap between the second side wall and an inner side wall of the sliding; and the second side wall being inclined from bottom of the groove.

4. The door closer of the claim 1, wherein the elastic component is a spring.

5. The door closer of claim 4, wherein the pulley is a cam, and the driving components comprises a driving piston configured at one end of the spring, and a cam roller on the driving piston;

the cam roller being tangent to the profile of the cam;

the other end of the spring being connected with a side wall of the receiving chamber.

6. The door closer of claim 5, wherein a housing is configured on the door, and receives the driving apparatus.

7. The door closer of claim 6, wherein the gas adjusting apparatus is embedded into the door frame, and the housing is embedded into the top of the door.

8. The door closer of claim 6, wherein the adjusting member is a regulating valve.

9. The door closer of claim 8, wherein the gas adjusting apparatus is embedded into the door frame, and the housing is embedded into the top of the door.

10. The door closer of claim 8, wherein the sliding rail is a cylinder, the regulating valve is configured on one end of the hermetic chamber, a vent is configured on the other end of the hermetic chamber, and a slot for the lever is arranged on the cylinder.

11. The door closer of claim 4, wherein the pulley is a gear, the driving component is a rack engaged with the gear, the rack is connected to one end of the spring, and the other end of the spring is connected with a side wall of the receiving chamber.

12. The door closer of claim 11, wherein a housing is configured on the door, and receives the driving apparatus.

13. The door closer of claim 12, wherein the gas adjusting apparatus is embedded into the door frame, and the housing is embedded into the top of the door.

14. The door closer of claim 12, wherein the adjusting member is a regulating valve.

15. The door closer of claim 14, wherein the sliding rail is a cylinder, the regulating valve is configured on one end of the hermetic chamber, a vent is configured on the other end of the hermetic chamber, and a slot for the lever is arranged on the cylinder.

16. The door closer of claim 14, wherein the gas adjusting apparatus is embedded into the door frame, and the housing is embedded into the top of the door.

17. An adjustable closer for a screen door hinged to a door frame for movement between open and closed positions, comprising;

a pneumatic cylinder for mounting to one of the door frame and the door;

a slide member slidably mounted in the pneumatic cylinder to define an air chamber in the pneumatic cylinder;

a spring mounted in the other of the door frame or the door;

a lever having opposite ends connected to the slide member and to the spring;

the spring compressing when the door opens and decompressing when the door closes;

the lever pulling and pushing the slide member within the pneumatic cylinder as the door opens and closes, respectively; and a valve on the pneumatic cylinder to control exhaust from the chamber as the door closes.

* * * * *